United States Patent [19]

Kobayashi

[11] Patent Number: 4,945,852

[45] Date of Patent: Aug. 7, 1990

[54] COMPACT PLANNING TYPE BOAT

[75] Inventor: Noboru Kobayashi, Iwata, Japan

[73] Assignee: Yamaha Hatsudoki Kabushiki Kaisha, Iwata, Japan

[21] Appl. No.: 240,100

[22] Filed: Sep. 2, 1988

[30] Foreign Application Priority Data

Sep. 4, 1987 [JP] Japan ..... 62-220392

[51] Int. Cl.[5] ..... B63B 35/86

[52] U.S. Cl. ..... 114/363; 114/270

[58] Field of Search ..... 114/363, 197, 270; 440/38

[56] References Cited

U.S. PATENT DOCUMENTS 2,655,121 10/1953 Cvneo ..... 114/197
3,397,670 2/1967 Bedford .
3,790,977 2/1974 Bombardier et al. .
4,425,863 1/1984 Cutler ..... 114/363
4,743,213 5/1988 Nishida ..... 114/270

FOREIGN PATENT DOCUMENTS 2183685 12/1973 France .
291292 12/1986 Japan ..... 114/363
325852 2/1930 United Kingdom .

*Primary Examiner*—Sherman D. Basinger
*Assistant Examiner*—Stephen P. Avila
*Attorney, Agent, or Firm*—Ernest A. Beutler

[57] ABSTRACT

A number of embodiments of small watercraft hull configurations wherein water may be permitted to enter into a rider's foot area if desired. Water barrier devices are incorporated, however, that will preclude water entry under normal running conditions.

6 Claims, 2 Drawing Sheets

COMPACT PLANNING TYPE BOAT

BACKGROUND OF THE INVENTION

This invention relates to a compact planing type of boat and more particularly to an improved arrangement for a compact watercraft wherein the occupants are protected from the unwanted intrusion of water.

There is a very popular type of small watercraft of the type in which one or two riders sit in straddle fashion on a seat that is positioned rearwardly of the steering tiller of the boat. With this type of watercraft, it is the practice to provide a pair of depressed footwells into which the riders may place their feet. Frequently, these footwells are opened through the rear of the hull so that water may enter into them under some conditions. For example, if an operator wishes to enter the watercraft directly from the water, there is an advantage to letting water enter the footwell portions of the watercraft so as to permit submersion of the stern of the watercraft to facilitate entry. Also, under some conditions it is desirable to permit submersion of at least a portion of the stern so as to improve handling.

This type of watercraft is normally operated by riders that are wearing swimming or wet suits. There are, however, numerous occasions when it is desirable to preclude the entry of water into the footwell portions. For example, the riders may operate such a watercraft in street clothes. Then, of course, it is very desirable to insure that their shoes will not become wet. However, the provision of a high transom which would preclude water entry makes it impossible to obtain the aforenoted advantages which can be enjoyed when water is permitted to enter into the footwell portions.

It is, therefore, a principal object of this invention to provide an improved compact watercraft of this type wherein water is precluded from entering into the footwell portions under most running conditions.

It is a further object of this invention to provide a watercraft hull configuration having depressed footwells into which water may flow for some purposes but not others.

SUMMARY OF THE INVENTION

This invention is adapted to be embodied in a small watercraft having a hull of the type providing a seating area adapted to accommodate at least a single rider seated in straddle fashion. The hull defines a pair of depressed footwell portions that extend on opposite sides of the center portion of the hull and which open through the rear of the hull so that water can enter into the footwell sections from the rear under at least some conditions. In accordance with the invention, there are provided raised water barriers that extend across the footwell portions forwardly of the end of the stern so as to preclude the entry of water under certain conditions while permitting the entry of water under other conditions.

DETAILED DESCRIPTION OF THE PREFERRED EMBODIMENTS OF THE INVENTION

Figure 1:
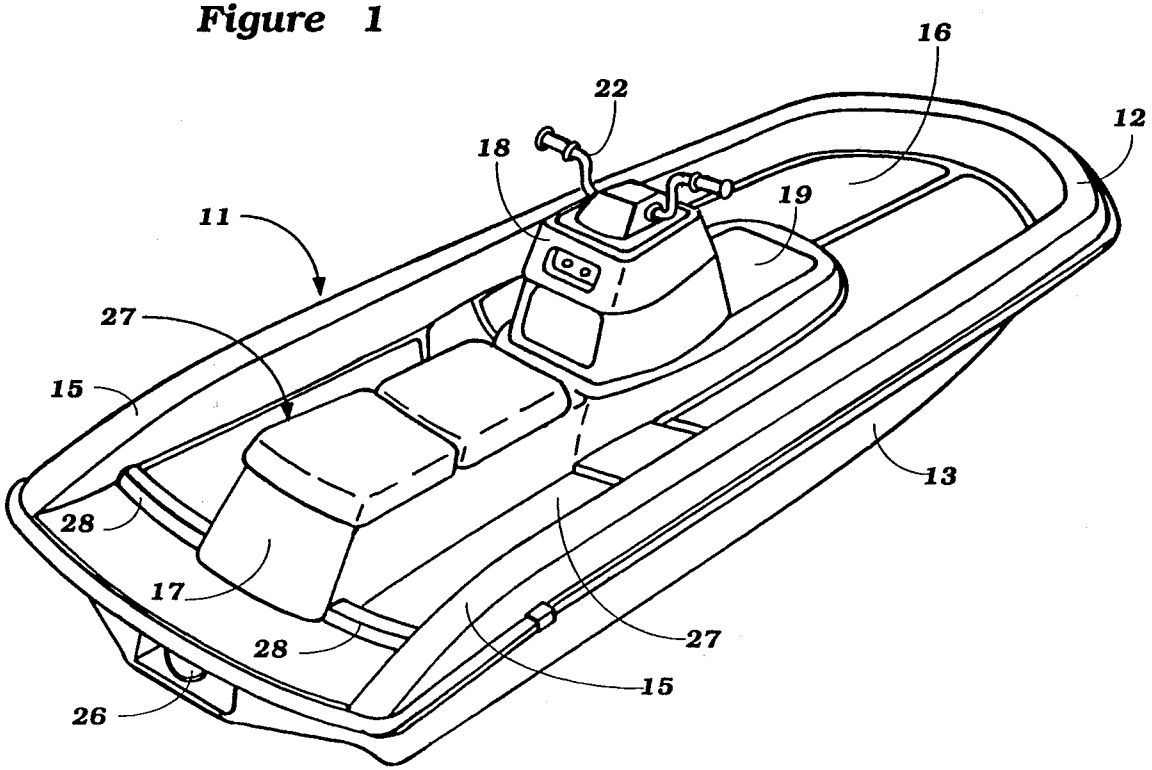
FIG. 1 is a perspective view, taken from above and from the rear, of a small watercraft constructed in accordance with a first embodiment of the invention.
Figure 2:
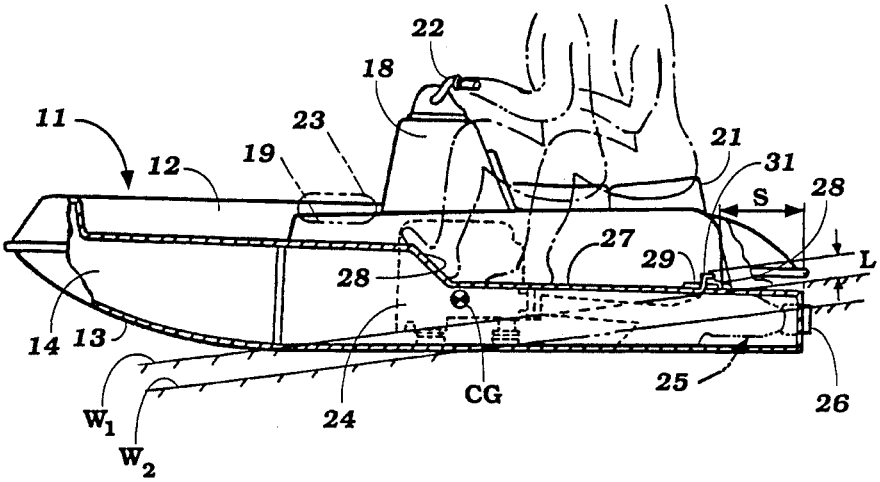
FIG. 2 is a side elevational view, with portions broken away, showing the watercraft and its attitude under certain running conditions with two riders aboard.

Referring first to the embodiment of FIGS. 1 and 2, a compact planing type watercraft constructed in accordance with this embodiment is identified generally by the reference numeral 11. The watercraft 11 is comprised of a hull that is made up of a synthetic resin, fiber reenforced and which consists of an upper hull portion 12 and a lower hull portion 13. The upper and lower portions 12 and 13 are connected together in any suitable manner. In addition, certain voids formed in the area between the upper and lower portions may be filled with a buoyant flotation material, indicated generally at 14. The flotation material 14 may be positioned in any desired location so as to achieve the desired center of buoyancy and center of gravity.

The upper hull portion 12 is provided with a raised perimeter section 15 that extends along the sides and bow and which defines a generally depressed central area 16. Rising from the central depressed area 16 is a central portion 17 which forms a bridge 18, front cowling or seat 19 and rear seating area on which a pair of rider's seats 21 may be positioned. A handlebar assembly 22 is carried by the bridge 18 for steering the watercraft in a manner to be described.

Riders may normally sit in straddle, tandem fashion on the seats 21 with the forwardmost rider steering the watercraft by the handlebar assembly 22. This riding condition is shown in phantom in FIG. 2. In addition, a forward seat 23 may be provided in the area 19 so as to accommodate a rider forwardly of the bridge 18.

The raised central area 17 further provides an area wherein an engine 24 of any known type may be housed so as to drive a jet propulsion unit 25 that is positioned in a recess in the rearward portion of the hull lower part 13 for powering the watercraft. The jet propulsion unit 25 has a pivotally supported discharge nozzle 26 that is steered by the handlebar assembly 22 for steering of the watercraft in a known manner.

It should be noted that the configuration is such that a pair of recessed footwells 27 are formed on opposite sides of the raised central portion 17 in proximity to the rear seats 21 so as to accommodate the rider's feet. A forwardly inclined portion 28 may be formed at the forward end so as to accommodate the forwardmost rider's feet. The recessed areas 27 in addition to affording the opportunity for comfortable seating, permits water to flow into the rear of the watercraft if a rider is displaced so that the rear of the watercraft may be submerged for ease of reentry. In addition, this rearward water entry can facilitate handling under some conditions.

Although this described rear water entry has advantages, there are also times when the riders may not wish their feet to become wet. This is particularly true if the riders are operating the watercraft in street clothing. In order to prevent water entry under this condition, while at the same time not sacrificing the aforedescribed submersion possibilities, there are provided a pair of raised water barriers 28 that extend transversely across the rearward portion of the footwells 27 at a distance S from the rear of the hull. By placing these water barriers 28 forwardly some distance from the rear of the hull, a lower height L is still capable of insuring that water cannot enter the area 27 under normal running conditions.

FIG. 2 shows the attitude of the watercraft when the riders are in place and when the watercraft is not operating. The water level under this condition assumes the line $W_1$. It will be seen that without the raised portions 28 that water could enter into the rider's area. However, even though the portions 28 are very shallow, they will be effective in precluding water entry. When the watercraft is operating in a planing condition, the water line $W_2$ parallels the line $W_1$ but the watercraft is less deeply submerged. The likelihood of water entry under this condition will be even less.

If desired, a water passage 29 may extend through the water barriers 28 and be provided with a one way check valve 31 that will permit any rainwater or any other water accumulating in the footwell areas 27 to drain rearwardly without permitting the water to flow in a forward direction through these passages under any condition.

Figure 3:
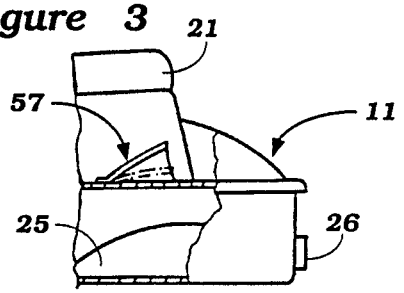
FIG. 3 is a partial side elevational view, in part similar to FIG. 2, showing another embodiment of the invention.

FIG. 3 shows another embodiment of this invention. In this embodiment, water barriers, indicated generally by the reference numeral 51 are provided forwardly of the stern but are in a cantilevered fashion and are formed from a readily deformable material. As such, the members 51 may be bent from the uppermost configuration as shown in solid lines to a lowered position as shown in phantom lines depending upon the weight of the passengers in the watercraft and the operator's desires.

Figure 4:
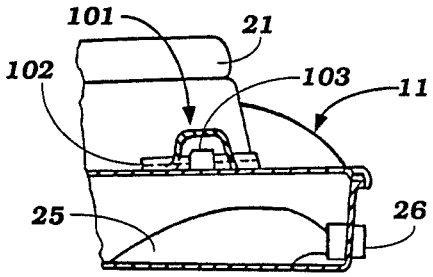
FIG. 4 is a partial side elevational view, in part similar to FIG. 3, showing another embodiment of the invention.

FIG. 4 shows yet another embodiment of the invention wherein a balloon shaped water barrier 101 is provided which may be inflated or otherwise deformed to desired heights. Like the embodiment of FIGS. 1 and 2, a water drain passage 102 in which a one way check valve 103 may be provided in this embodiment so as to permit water to drain from the footwell area 28 but not enter into it.

It should be readily apparent from the foregoing descriptions that a number of embodiments of the invention have been illustrated and described, each of which is very effective in precluding unwanted water entry into the foot area of a small watercraft while, at the same time, permitting the operator to submerge the rear of the watercraft and flood the foot areas if he so desires. Although a number of embodiments of the invention have been illustrated and described, various changes and modifications may be made without departing from the spirit and scope of the invention, as defined by the appended claims.

I claim:

1. A hull configuration for a small watercraft having a raised peripheral area defining a depressed central area in which a rider's feet are adapted to be positioned, said depressed central area opening through the stern of the watercraft for permitting water to flow into the depressed central area through the stern, the improvement comprising water barrier means formed in said depressed central area forwardly of the stern and below the level of said raised peripheral area for precluding the flow of water past said water barrier means into said depressed central area and one way check valve means for permitting water to flow from the depressed central area rearwardly out of the stern and not into the depressed central area from the stern.

2. A hull configuration for a small watercraft as set forth in claim 1 wherein there is a raised central portion in the depressed central area forming a seat on which a rider may sit in straddle fashion and dividing said depressed central area into two laterally spaced foot areas.

3. A hull configuration for a small watercraft as set forth in claim 2 wherein said water barrier means includes a pair of water barriers each extending from the raised central portion to the outer periphery of the foot area at a respective side of said raised central portion.

4. A hull configuration for a small watercraft as set forth in claim 1 wherein the water barrier means is deformable for altering its effective height.

5. A hull configuration for a small watercraft as set forth in claim 3 wherein the foot areas merge at at least one end to form a generally U-shape configuration around the raised central and wherein there is provided a bridge on the central portion to the rear of the bridge and a second part to the front of the bridge.

6. A hull configuration for a small watercraft as set forth in claim 5 wherein the foot area extends through the transom and wherein the water barrier means is positioned forwardly of the transom and contiguous to the rear of the seat.

* * * * *